US005155373A

United States Patent [19]

Tsuchiya et al.

[11] Patent Number: 5,155,373

[45] Date of Patent: * Oct. 13, 1992

[54] DIVING APPARATUS FOR STARTING AN ENGINE WITH A STARTING MOTOR ENERGIZED BY A CAPACITOR

[75] Inventors: Yoshinobu Tsuchiya, Fujisawa; Ken Kurabayashi, Chigasaki; Akihiro Shirata, Yokohama, all of Japan

[73] Assignee: Isuzu Motors Limited, Tokyo, Japan

[ * ] Notice: The portion of the term of this patent subsequent to Sep. 8, 2009 has been disclaimed.

[21] Appl. No.: 500,460

[22] Filed: Mar. 28, 1990

[30] Foreign Application Priority Data

Apr. 13, 1989 [JP] Japan ..... 1-093361

[51] Int. Cl.[5] ..... F02N 11/00

[52] U.S. Cl. ..... 290/38 R; 123/179 G

[58] Field of Search ..... 123/179 G; 290/38

[56] References Cited

U.S. PATENT DOCUMENTS 4,467,748 8/1984 Watanabe ..... 123/179 G

OTHER PUBLICATIONS

J. Kaiser, "Electrical Power, Motors, Controls, Genstators, Transformers" (1982). pp. 145–165.

A. E. Fitzgerald et al. "Electric Machinery" (5th Ed. 1990), pp. 488–497.

*Primary Examiner*—A. D. Pellinen

*Assistant Examiner*—Lawrence E. Colbert

*Attorney, Agent, or Firm*—Staas & Halsey

[57] ABSTRACT

An engine starter system for driving an engine starter with electric power from a battery mounted on a motor vehicle has a pair of large-capacitance capacitors which are selectively connected to the battery and the starter. One of the capacitors is connected to the battery and charged thereby when the detected voltage across the one capacitor is lower than a predetermined voltage, and the other capacitor which is charged sufficiently enough is connected to the starter. Electric energy whose voltage is higher than the predetermined voltage is therefore continuously supplied to the starter to start the engine.

5 Claims, 2 Drawing Sheets

DIVING APPARATUS FOR STARTING AN ENGINE WITH A STARTING MOTOR ENERGIZED BY A CAPACITOR

BACKGROUND OF THE INVENTION

The present invention relates to an engine starter system for driving an engine starter to start the engine.

Internal combustion engines used as motor vehicle power sources are normally started by a starter motor which comprises a DC series motor. Electric power is supplied from a vehicle-mounted battery to the starter motor, which is energized to cause a pinion gear mounted thereon to rotate a ring gear mounted on the crankshaft and meshing with the pinion gear. Therefore, the crankshaft is rotated to start the engine.

An electric current which is supplied from the battery to the starter motor when starting the engine is very high, e.g. 100 A or more, though it is supplied in a short period of time. Therefore, the electric power consumption by the battery is quite large. The capacity of a battery to be installed on a motor vehicle is determined primarily in view of its ability to start the engine. The large electric power which is consumed to start the engine is supplemented when the battery is charged by electric power generated by an alternator mounted on the motor vehicle and driven by the engine while the motor vehicle is running.

Batteries mounted on motor vehicles are known lead batteries as secondary batteries, and they are charged and discharged through a chemical reaction between electrodes and an electrolytic solution. Such a battery can discharge a large current within a short period of time. The battery is charged with a current of 10 A or less which is supplied over a long period of time and through a gradual chemical reaction. Therefore, if a much larger current is supplied to charge the battery, the battery would be excessively heated and the electrodes might be deformed and damaged.

Motor vehicles which are mainly used by commuters run over short distances, and motor vehicles used as delivery cars are repeatedly stopped and started highly frequently. Since these motor vehicles require the engines to be started frequently and are continuously driven over short periods of time, the batteries mounted on these motor vehicles cannot be charged sufficiently enough to make up for the electric power consumed when the engines are started. Accordingly, the batteries tend to be used up, failing to start the engines.

To solve the above problems, the applicant has proposed a motor vehicle power supply device which has a large-capacitance capacitor that is charged by a battery mounted on the motor vehicle and that discharges stored electric energy to actuate the engine starter to start the engine (see Japanese Patent Application No. 63(1988)-329,846, U.S. patent application Ser. No. 454,267 and EPC Patent Application No. 89313559.0.

The voltage of a battery does not drop when it is discharged in a short period of time, but the voltage of a capacitor drops greatly when it is discharged. When the lubricating oil of an engine is of high viscosity and the engine is subjected to large friction, at the time the engine is started in cold climate, large electric power is supplied to the engine starter to start the engine. At this time, the voltage across the capacitor drops, making it difficult to start the engine. This drawback may be eliminated if the capacitance of the capacitor is increased, but there is a practical limitation on the capacitance of the capacitor.

SUMMARY OF THE INVENTION

It is an object of the present invention to provide an engine starter system which can drive an engine starter in colder conditions and can easily actuate the engine starter even when the capacity of a battery is reduced.

Another object of the present invention is to provide an engine starter system which is capable of continuously supplying electric power at a certain voltage or higher to an engine starter.

According to the present invention, there is provided an engine starter system comprising a battery, an engine starter for starting an engine with electric power from the battery, a plurality of large-capacitance capacitors, switching means for selectively connecting the capacitors to the battery and the starter, voltage detecting means for detecting voltages across the capacitors, and control means for controlling the switching means to connect one of the capacitors to the battery when the voltage across the one capacitor, detected by the voltage detecting means, is lower than a predetermined voltage, and to connect one of the capacitors to the starter when the voltage across the last-mentioned one capacitor, detected by the voltage detecting means, is higher than the predetermined voltage.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
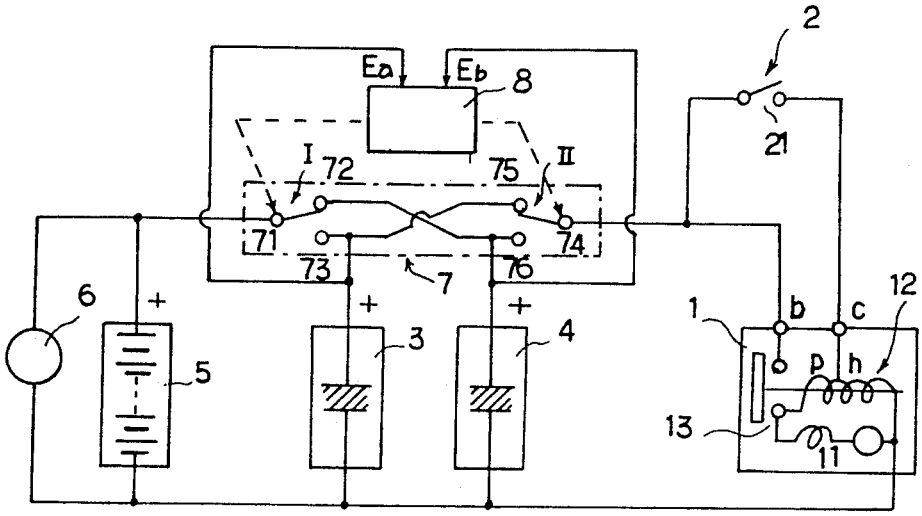
FIG. 1 is a circuit diagram, partly in block form, of an engine starter system according to an embodiment of the present invention.

FIG. 1 shows an engine starter system according to an embodiment of the present invention.

The engine starter system includes an engine starter 1 which comprises a known series motor 11 and a magnet switch 12 having a pull-in coil p and a holding coil h. When a contact 21 of a starter switch 2 is closed and these coils p, h are energized through a terminal c, they magnetically attract a movable contact 13 of the magnet switch 12 to close the contact 13. Then, a large electric current is supplied through a terminal b to the motor 11, which is energized to rotate the crankshaft of an engine (not shown) on a motor vehicle, thereby starting the engine.

First and second capacitors 3, 4 are of a large capacitance. Each of these first and second capacitors 3, 4 is typically an electric double layer capacitor used as a backup power supply for a memory in an electronic device, and has an electrostatic capacitance of about 100 F (farad), for example. When these capacitors 3, 4 are charged, they can store a large amount of electric energy within a short period of time. The capacitors 3, 4 are controlled by a switching control circuit (described later on) to store electric energy supplied from a vehicle-mounted battery 5 or supply the stored electric energy to the starter 1 to start the engine. The battery 5 comprises an ordinary lead battery which can be charged by an alternator 6 which is driven by the torque produced by the engine.

The switching control circuit 7 has a two-circuit, two-contact switching circuit arrangement which can selectively handle large currents. The switching control circuit 7 has two single-pole, double-throw switch circuits which can simultaneously be operated under a control signal from a controller 8.

One of the switch circuits, I, has a common contact 71 connected to the positive terminal of the battery 5, an upper contact 72 connected to the positive terminal of the second capacitor 4, and a lower contact 73 connected to the positive terminal of the first capacitor 3. The other switch circuit II has a common contact 74 connected to the terminal b of the starter 1, an upper contact 75 connected to the positive terminal of the first capacitor 3, and a lower terminal 76 connected to the positive terminal of the second capacitor 4. When one of the first and second capacitors 3, 4 is connected to the battery 5, the other capacitor is always connected to the terminal b of the starter 1.

The controller 8 is supplied with voltage signals from the first and second capacitors 3, 4, the voltage signals being indicative of the voltages across the capacitors 3, 4. When the voltage across one of the capacitors 3, 4 becomes lower than a predetermined voltage, the controller 8 detects such a voltage drop and applies a control signal to the switching control circuit 7 to connect the capacitor with the lowered voltage to the battery 5. The switch circuits I, II are then operated to charge that capacitor with the battery 5 and at the same time to connect the other capacitor to the starter 1. Normally, the first and second capacitors 3, 4 store a predetermined amount of electric energy.

Figure 2:
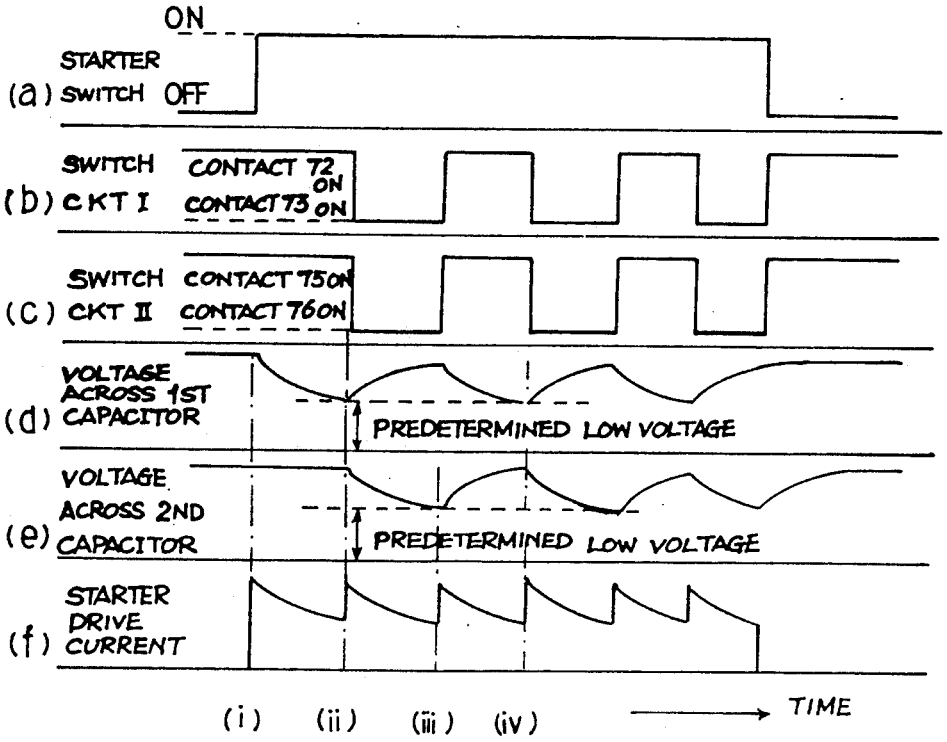
FIG. 2 is a timing chart of signals in various components of the engine starter system shown in FIG. 1.

FIG. 2 shows the waveforms of various signals produced in the engine starter system when the the engine is to be started. FIG. 2 shows the turning on and off of the starter switch 2 at (a), the switching operation of the switch circuit I at (b), and the switching operation of the switch circuit II at (c). When the switch circuits I, II are thus actuated for their switching operation, the voltage across the first capacitor 3 varies as indicated at (d), the voltage across the second capacitor 4 varies as indicated at (e), and the current supplied to drive the starter 2 varies as indicated at (f).

Operation of the engine starter system will now be described with reference to FIGS. 1 and 2.

To start the engine, the starter switch 2 is closed at a time (i). With the contacts of the switching control circuit 7 being positioned as shown in FIG. 1, the electric energy stored in the first capacitor 3 is supplied through the contacts 75, 74 of the switching control circuit 7 to the terminal c of the starter 1, whereupon the coils p, h are energized to close the main contact 13. The electric energy of the first capacitor 3 is supplied through the terminal b and the main contact 13 to the motor 11. When the voltage Ea across the first capacitor 3 gradually drops and becomes lower than a predetermined voltage at a time (ii), as shown in FIG. 2 at (d), the controller 8 detects such a voltage drop and produces a control signal to shift the contacts 71, 74 to the contacts 73, 76 as shown in FIG. 2 at (b) and (c). The second capacitor 4 immediately starts to be discharged at the time (ii) to keep the motor 21 continuously energized. On the other hand, the first capacitor 3 is connected to the battery 5 and charged thereby as shown in FIG. 2 at (d) between the times (ii) and (iii).

When the voltage Eb across the second capacitor 4 drops lower than the predetermined voltage at the time (iii), the controller 8 controls the switching control circuit 7 to cause the charged first capacitor 3 to discharge its stored electric energy. Therefore, the starter motor 21 is continuously supplied with a sawtooth current as shown in FIG. 2 at (f), and is energized thereby to start the engine. The starter motor 21 is thus supplied with electric power under voltages higher then the predetermined voltage, alternately from the first and second capacitors 3, 4. After the engine has started, the starter switch 2 is opened, allowing the main contact 13 to be opened. Therefore, the first and second capacitors 3, 4 stop being discharged, and each store a predetermined amount of electric energy under the control of the controller 8.

Figure 3:
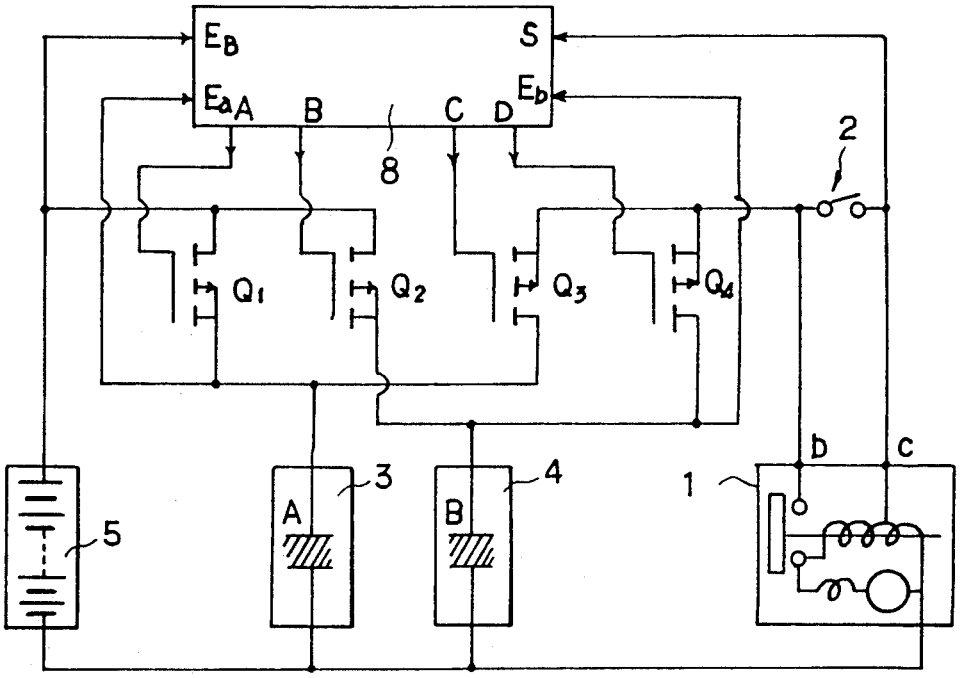
FIG. 3 is a circuit diagram, partly in block form, of an engine starter system according to another embodiment of the present invention.
Figure 4:
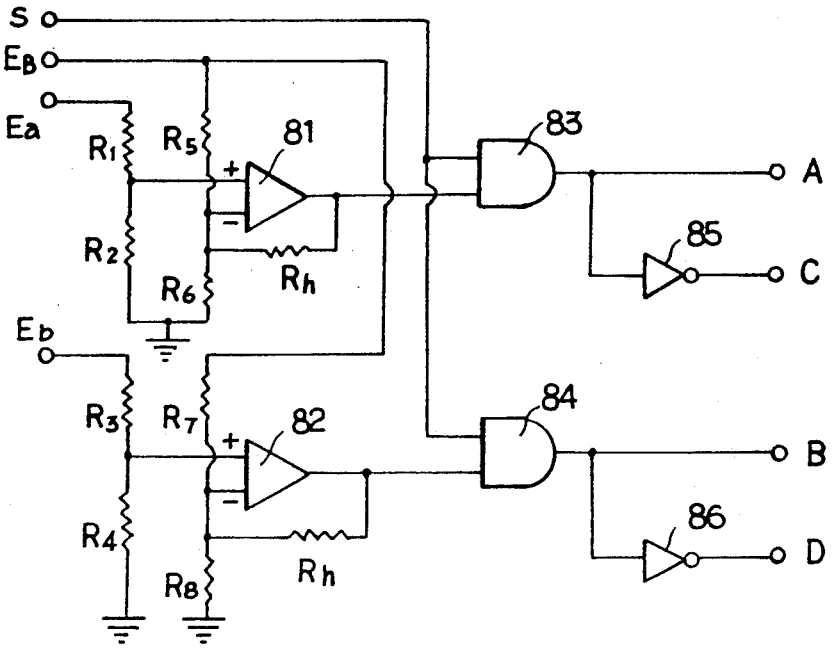
FIG. 4 is a circuit diagram, partly in block form, of a switching controller which is used in the engine starter system shown in FIG. 3.

FIG. 3 shows an engine starter system according to another embodiment of the present invention, the engine starter system employing semiconductors in its switching control circuit. FIG. 4 shows the circuit arrangement of a controller in the engine starter system.

The switching control circuit in the engine starter system shown in FIG. 3 includes large-current MOSFETs (metal-oxide-semiconductor field-effect transistors) Q1 through Q4 for switching on and off charging and discharging currents for the capacitors 3, 4. The MOSFETs Q1, Q3 correspond to the switch circuit I (FIG. 1) and the MOSFETs Q2, Q4 correspond to the switch circuit III. These MOSFETs Q1 through Q4 have gates connected to a controller 8 which applies control signals A through D to control conduction of the MOSFETs Q1 through Q4.

As shown in FIG. 4, the controller 8 includes voltage comparators 81, 82 for comparing voltages Ea, Eb across the first and second comparators 3, 4 with a voltage signal EB from the battery 5. When the voltage Ea or Eb is lower than the voltage signal EB, the voltage comparator 81 or 82 produces an output signal which is applied to one input terminal of an AND gate 83 or 84. The other input terminals of the AND gates 83, 84 are supplied with a signal S from the terminal c of the starter 1. When the signal S and the output signal from the comparator 81 or 82 are applied as input signals, the AND gate 83 or 84 produces the control signal A or B to be applied to the MOSFET Q1 or Q2. Inverters 85, 86 are connected to the output terminals of the AND gates 83, 84, respectively, and apply signals, which are inverted output signals from the AND gates 83, 84, to the MOSFETs Q3, Q4 for smoothly switching on and off the charging and discharging currents. Hysteresis setting resistors Rh are shunted across the voltage comparators 81, 82, respectively, to give hysteresis characteristics to the operation of the voltage comparators 81, 82.

With the engine starter system shown in FIGS. 3 and 4, when the starter switch 2 is closed, the electric energy stored in one of the capacitors 3, 4 is supplied to the starter 1. In response to detection by one of the voltage comparators 81, 82 of a predetermined voltage drop owing to the discharging of said one capacitor, the controller 8 applies control signals to charge the capacitor with the battery 5, and to supply the stored electric energy from the other capacitor to the starter 1. Such alternate charging and discharging of the capacitors 3, 4 is repeated to start the engine.

Although certain preferred embodiments have been shown and described, it should be understood that many changes and modifications may be made therein without departing from the scope of the appended claims.

What is claimed is:

1. A driving apparatus for supplying electric power to a starter motor coupled to a crankshaft of an engine mounted on a motor vehicle for driving the starter motor, and starting the engine with the starter motor, said driving apparatus comprising:

a battery;

an engine starter for starting an engine with electric power from said battery;

a plurality of large-capacitance capacitors;

switching means for selectively connecting said capacitors to said battery and said starter;

voltage detecting means for detecting voltages across said capacitors; and control means for controlling said switching means to connect one of said capacitors to said battery when the voltage across said one capacitor, detected by said voltage detecting means, is lower than a predetermined voltage, and to connect one of said capacitors to said starter when the voltage across said last-mentioned one capacitor, detected by said voltage detecting means, is higher than said predetermined voltage.

2. A driving apparatus according to claim 1, wherein each of said capacitors comprises an electric double layer capacitor.

3. A driving apparatus according to claim 1, wherein said plurality of large-capacitance capacitors comprise two large-capacitance capacitors, and wherein said switching means comprises a first switch circuit for selectively connecting said two capacitors to said battery, and a second switch circuit for selectively connecting said two capacitors to said battery.

4. A driving apparatus according to claim 3, wherein said two capacitors comprise first and second capacitors, respectively;

wherein said switching means comprises:

a first switch circuit having a first common contact connected to said battery and first and second contacts connected to said second and first capacitors, respectively; and a second switch circuit having a second common contact connected to said starter and third and fourth contacts connected to said first and second capacitors, respectively; and wherein said control means comprises means for simultaneously controlling said first and second switch circuits such that said first and second common contacts are connected to either said first and third contacts, respectively, or said second and fourth contacts, resepcitvely.

5. A driving apparatus according to claim 3, wherein said first switch circuit comprises two MOSFETs and said second switch circuit comprises two MOSFETs.

* * * * *

UNITED STATES PATENT AND TRADEMARK OFFICE

CERTIFICATE OF CORRECTION

PATENT NO. : 5,155,373

DATED : OCTOBER 13, 1992

INVENTOR(S) : YOSHINOBU TSUCHIYA ET AL.

It is certified that error appears in the above-identified patent and that said Letters Patent is hereby corrected as shown below:

Title Page [54] "DIVING" should be --DRIVING--;

[56] Col. 2, line 2, "Gensta-" should be --Genera- --.

Col. 1, line 1, "DIVING" should --DRIVING--.

Col. 6, line 28, "resepcitvely" should be --respectively--.

Signed and Sealed this

Fifth Day of October, 1993

Bruce Lehman

*Attest:*

BRUCE LEHMAN

*Attesting Officer*

*Commissioner of Patents and Trademarks*